United States Patent [19]

Popovitch

[11] 3,961,578

[45] June 8, 1976

[54] POINT-DETONATING PROJECTILE FUZE

[75] Inventor: Dragolyoub Popovitch, Denville, N.J.

[73] Assignee: The United States of America as represented by the Secretary of the Army, Washington, D.C.

[22] Filed: Mar. 1, 1974

[21] Appl. No.: 447,452

[52] U.S. Cl. ..... 102/78; 102/73 A; 102/74; 102/85.2

[51] Int. Cl.[2] ..... F42C 1/04

[58] Field of Search ..... 102/73 R, 74, 75, 78, 102/79, 85.2, 73 A

[56] References Cited

UNITED STATES PATENTS

| | | | |
|---|---|---|---|
| 1,224,631 | 5/1917 | Girdwood | 102/79 |
| 1,318,098 | 10/1919 | Midgley | 102/73 A |
| 1,786,640 | 12/1930 | Zornig et al. | 102/74 |
| 2,483,555 | 10/1949 | Nichols | 102/74 |
| 2,513,536 | 7/1950 | Wellington | 102/73 A |
| 2,529,483 | 11/1950 | Byrnes, Jr. | 102/74 |
| 2,701,527 | 2/1955 | Granath et al. | 102/75 |
| 3,185,090 | 5/1965 | Weber | 102/49.5 |
| 3,633,510 | 1/1972 | Bernardin | 102/74 |
| 3,718,093 | 2/1973 | Milanowski | 102/73 A |

FOREIGN PATENTS OR APPLICATIONS

| | | | |
|---|---|---|---|
| 27,609 | 6/1904 | United Kingdom | 102/85.2 |

*Primary Examiner*—Harold Tudor
*Attorney, Agent, or Firm*—Nathan Edelberg; A. Victor Erkkila; Thomas R. Webb

[57] ABSTRACT

A fuze for a spin-stabilized artillery projectile comprises a body including: an ogive member containing point-detonating firing means, selectable for super-quick or delay firing; and a base member containing an inertial delay fuze operable by either direct or graze impact, a combustible fuse loop surrounding the inertial delay fuze and exposed to the point-detonating firing means, and a firing train coupling the inertial delay fuze and the fuse loop to a booster charge for initiating the main explosive charge of the projectile. The inertial delay fuze may comprise a cylindrical housing including a rear wall, an outer cylindrical wall and a front wall including a rearward tubular extension forming an annular chamber, a rearwardly-biased firing pin slidable in the tubular extension, a rearwardly-biased, annular, locking member slidable in the annular recess from a rear position, wherein it engages a series of detent balls which hold the firing pin in safe position, to a forward, firing pin-releasing position, a detonator positioned to be fired by the firing pin, and a series of spherical inertial weights which engage inclined cam surfaces on the locking member to force the latter forwardly on graze impact with a target.

11 Claims, 10 Drawing Figures

POINT-DETONATING PROJECTILE FUZE

SUMMARY OF THE INVENTION

The present invention relates to an improved fuze for initiating the main charge of a spin-stabilized projectile, such as a 75mm artillery shell.

An object of the invention is to provide a fuze in the form of an integrated structure by providing two parallel but independent firing trains, one actuated by direct or point-denoting impact with a target, and the other actuated, with some delay, by graze impact. Preferably, each firing train includes spin-actuated safety locking means for preventing firing before launch.

Another object is to provide a new and improved inertial delay fuze.

DETAILED DESCRIPTION OF A PREFERRED EMBODIMENT

Figure 1:
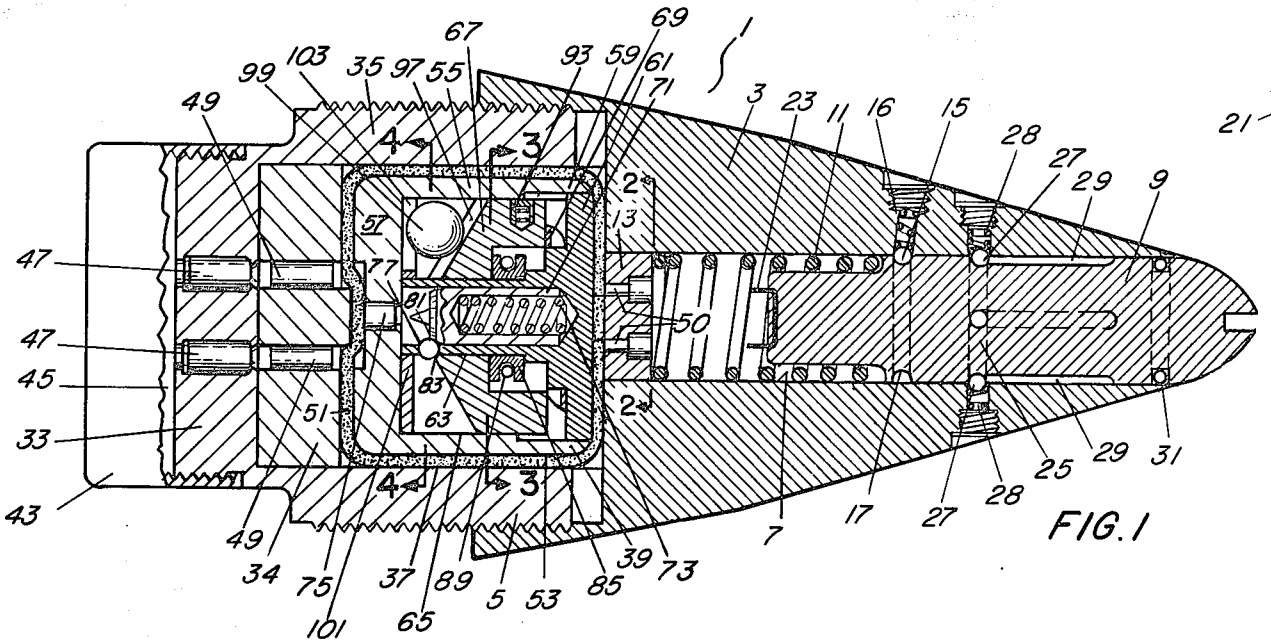
FIG. 1 is a longitudinal section view of a fuze incorporating the invention, with all of the parts in safe condition.

FIG. 1 shows a fuze 1 incorporating the present invention, for use on a spin-stabilized projectile, such as a 75mm artillery shell. Fuze 1 comprises a hollow body made up of a forward, ogive portion 3 threaded onto a rear or base portion 5.

Figure 2:
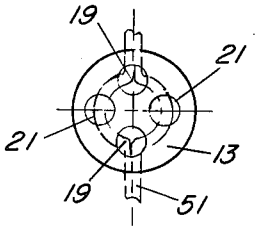
FIG. 2 is a fragmentary transverse section view, taken on line 2—2 of FIG. 1.

Ogive portion 3 has a central bore 7 therethrough in which a direct impact or point-detonating (P.D.) firing member or rod 9 is slidable. Firing member 9 is biased forwardly by a coil spring 11, which abuts a plug 13 fixed in the rear end of bore 7. Prior to projectile launch, the firing member 9 is axially locked in forward, safe position by an inwardly-biased spin detent ball 15 which seats in a circumferential groove 17 in the member 9. Two diametrically-opposite super-quick (S.Q.) detonators 19 and two alternate, diametrically-opposite delay detonators 21 are mounted in plug 13 (see FIG. 2). Two diametrically-opposite firing points or pins 23 are mounted on firing member 9, facing the detonators 19 or 21, as selected. Firing member 9 is formed with a circumferential groove 25 in which two guide detent balls 27 are held by strong springs 28, to permit rotation of the member 9 to selectively align the points 23 with either the S.Q. or the delay detonators. Four shallow, longitudinal grooves 29 in the member 9 permit longitudinal movement of the member 9 relative to the balls 27, for point detonation of the fuze on direct impact. An O-ring seal 31 may be provided between the firing member 9 and ogive portion 3.

Figure 6:
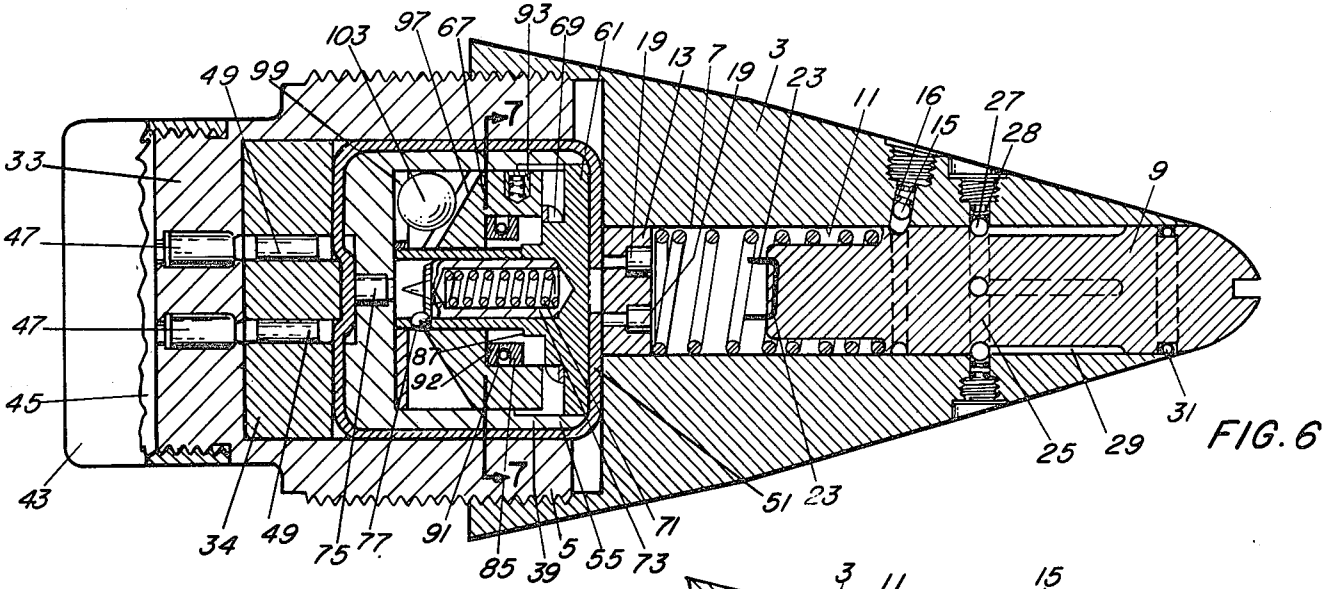
FIG. 6 is a view similar to FIG. 1, with the firing member in armed position and the locking member unlocked ready to release the firing pin on impact with a target.
Figure 5:
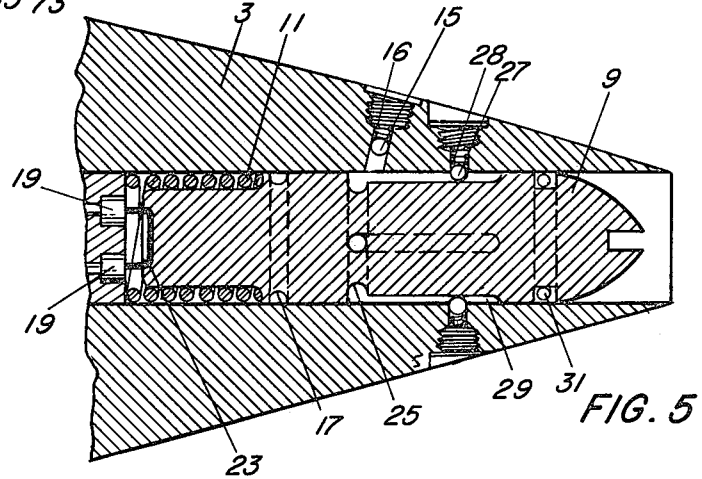
FIG. 5 is a longitudinal section view of the ogive portion of the fuze of FIG. 1, with the point-denoting firing member in fired position for the super-quick mode.
Figure 8:
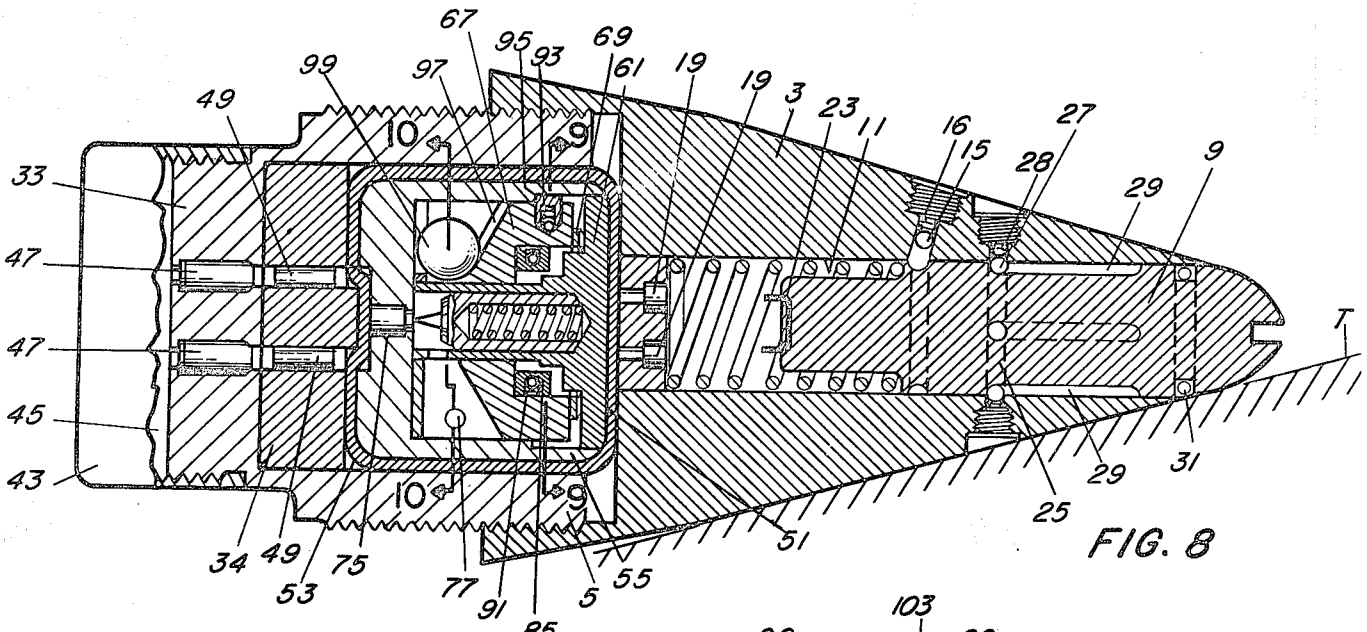
FIG. 8 is a view similar to FIG. 6, with the firing pin released by the locking member as a result of graze impact at a high angle of incidence.

FIG. 1 shows the P.D. elements in safe condition prior to launch. As the projectile is launched and begins to spin (due to the usual engagement of the projectile with the rifling in the gun barrel), the spin detent ball 15 moves outward by centrifugal force against a relatively weak spring 16, releasing the firing member 9, as shown in FIGS. 5, 6 and 8. FIG. 5 shows the firing member in fired position as a result of direct impact (small incident angle) with a target, with the S.Q. detonators 19 being fired.

Base portion 5 is cup-shaped with a base 33, a block 34 and a side wall 35 forming a cylindrical capacity 37 which is closed at the front end by the ogive portion 3 and plug 13. An inertial delay fuze having a housing 39 is disposed within the cavity 37. Attached to the rear end of base 33 is a booster housing 43 containing a booster explosive material 45. Booster material 45 is coupled to the cavity 37 by two leads 47 in the base 33 and two S.Q. detonators 49 in the block 34. The detonators 19 and 21 are coupled to the detonators 49 by means of four flash passages 50 in the plug 13 and a closed double loop 51 of combustible fuse material disposed in a continuous groove 53 in the outer surface of housing 39, so that the P.D. firing of either of the detonators 19 and 21 is immediately transmitted to the booster 43, to explode the main explosive charge (not shown) of the projectile to which fuze 1 is attached. It will be understood that a conventional safing rotor, and/or set-back lock and timing mechanism (not shown) may be incorporated in the block 34 between the loop 51 and leads 47, to provide additional safety or delay.

Figure 4:
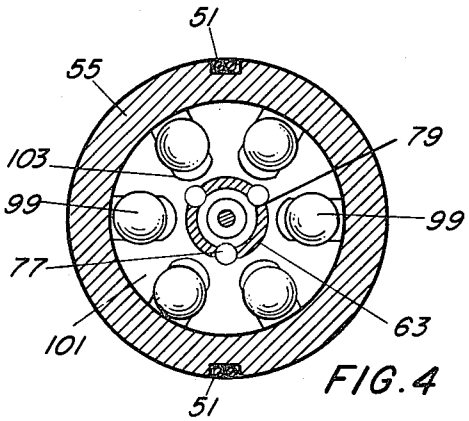
FIGS. 3 and 4 are transverse sections of the inertial portion of the fuze, taken on lines 3—3 and 4—4, respectively, of FIG. 1.
Figure 3:
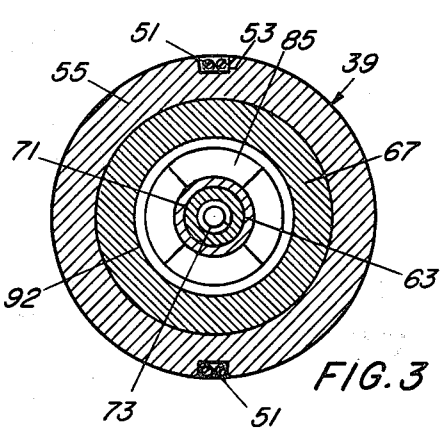
Figure 7:
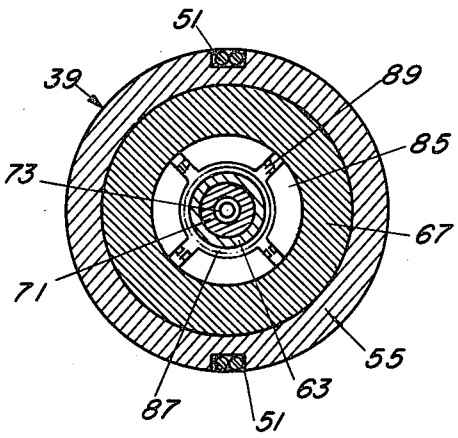
FIG. 7 is a view, similar to FIG. 3, taken on line 7—7 of FIG. 6.

The fuse housing 39 comprises a cup-shaped member 55, including a base or rear wall 57 and an outer wall 59, and a front wall 61. The front wall 61, which is separate from but attached to member 55, for assembly purposes, comprises a tubular rearward extension 63 which cooperates with the outer wall 59 to form an annular recess 65. Slidably disposed in recess 65 is an annular locking member or weight 67 which is biased by a wavy creep spring 69 to a rear, safe position, as shown in FIG. 1. An elongated firing pin 71 is slidably mounted within tubular extension 63, biased rearwardly by a coil spring 73. A S.Q. detonator 75 extends through the center of the rear wall 57 in position to be struck by the firing pin 71 and explode adjacent to loop 51, which then initiates the detonators 49, leads 47 and booster 43. The firing pin 71 is held in the safe position shown in FIG. 1 by three detent balls 77 (see also FIG. 4) which are disposed in three radial openings 79 in extension 63 and held in engagement with a shoulder 81 on the firing pin 71 by a shoulder 83 on the locking member 67, when the latter is in the rearmost position. Prior to launch, the locking member 67 is locked in this rearmost position by a series of four, arcuate, spin detents 85. The spin detents 85, which constitute segments of a complete ring, as shown in FIG. 3, closely surround the extension 63 behind a rearwardly-facing shoulder 87 thereon, in the safe position, being held together by a garter spring 89 mounted in external grooves 91. The rear sides of the detents 85 abut the radial face of an annular recess 92 in locking member 67, in which recess the detents are disposed. At launch, when the projectile achieves sufficient spin, the detents 85 move out, beyond the shoulder 87, thus releasing the locking member 67, as shown in FIGS. 6 and 7. However, the locking member 67 is retained by the creep spring 69 in its rear or safe position prior to impact.

Figure 9:
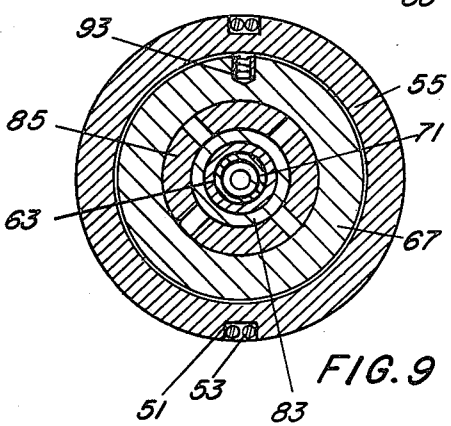

When the fuze impacts a target substantially head-on, the locking member 67 moves forwardly, by inertia, thus releasing the balls 77 which, in turn, release the firing pin 71. Due to its own inertia, the firing pin 71 also moves forward, and does not strike the detonator 75 until the deceleration of the fuze drops so low that the force of the firing pin spring 73 becomes greater than the forward locking force of the firing pin 71. The locking member 67 is locked in its forward position of FIGS. 8 and 9 by a spring-biased detent 93, in the locking member 67, that moves outwardly past a shoulder 95 on the outer wall 59, as shown in FIGS. 8 and 9.

Figure 10:
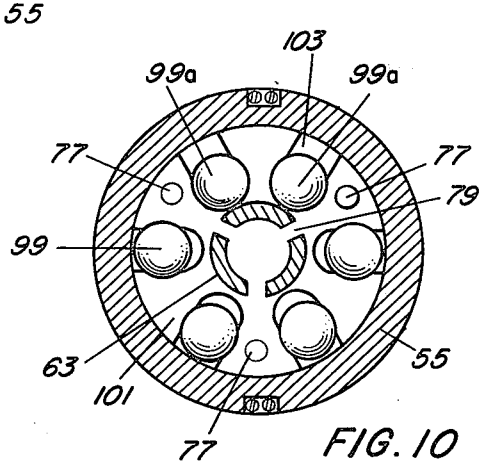
FIGS. 9 and 10 are transverse section views taken on lines 9—9 and 10—10, respectively, of FIG. 8.

To accommodate graze impact at a large angle of incidence (approaching 90°), the rear end of locking member 67 is formed with a series (six, as shown) of outwardly-and-forwardly inclined cam grooves 97, in which a corresponding number of spherical weights 99 are located. A guide plate 101 having radial slots 103 may also be mounted in the rear end of annular recess 65, to assist in guiding the weights 99 in radial planes. If plate 101 is provided, the inclined grooves 97 may be replaced by a smooth conical rear end surface on the locking member 67, to permit free rotation of the locking member. In the safe position of locking member 67, the weights 99 are all located at the outer ends of the grooves 97 and/or slots 101, as shown in FIGS. 1 and 3. At graze impact with a target T at an angle of incidence too large to reliably move the locking member 67 forward by its inertia alone, the weight or weights 99a on the side of the fuze opposite the point of impact move inwardly by their own inertia, along the cam grooves 97, to the inner positions shown in FIGS. 8 and 10, thus forcing the locking member 67 forwardly to release the firing pin 71.

I claim:

1. An inertial graze-impact fuze comprising:

a hollow cylindrical housing including outer, front and rear walls; said housing having a tubular portion extending axially from one of said front and rear walls with at least one radial opening therein;

a firing pin slidably disposed in said tubular portion with a spring interposed between said front wall and said firing pin for biasing said firing pin rearwardly;

a detonator disposed adjacent to the rear end of said tubular portion, in line with said firing pin;

an annular locking member slidable in said housing, in the space between said outer wall and said tubular portion, independently of said firing pin;

a creep spring between said locking member and said front wall to bias said locking member rearwardly independently of said firing pin;

spin-releasable detent means locking said locking member in a rearward position in the safe condition of said fuze;

a detent ball disposed partially in said opening for locking said firing pin in a safe position spaced from said detonator, and means carried by said locking member for holding said detent ball in locking position in said safe condition; and inertia means, responsive to transverse or graze impact of said fuze with a target, for positively moving said locking member forwardly in opposition to said creep spring, after being released by said detent means during launch, to release said detent ball and unlock said firing pin, whereby said firing pin is free to be moved rearwardly by its spring to fire said detonator after the forward inertia force of said firing pin at impact becomes less than the force of said firing pin spring; said inertia means comprising a plurality of spherical weights all of which initially engage outer portions of at least one outwardly-and-forwardly inclined camming surface on the rear end of said locking member and a radial surface at the rear of said housing, and at least one of which moves inwardly upon said graze impact to move said locking member forwardly.

2. A fuze as in claim 1, further comprising detent means for locking said locking member in its forward position after impact.

3. A fuze as in claim 1, wherein said tubular portion has an annular series of radial openings, and a detent ball is disposed partially in each of said openings, with each ball engaging said locking member and said firing pin in the rearward position of said locking member.

4. A fuze as in claim 1, wherein said detonator is carried by and extends through said rear housing wall.

5. A fuze structure for an explosive projectile, comprising:

a cup-shaped base;

an ogive member attached to the open end of said base to form therewith a coaxial cylindrical cavity;

an inertial fuze disposed in said cavity and including a first detonator disposed adjacent to said base and inertia-operated means responsive to transverse graze impact of said fuze with a target for exploding said first detonator;

a continuous loop of combustible fuze material extending around said inertial fuze in an axial plane, with the rear side thereof between said base and said first detonator, said loop being otherwise isolated from said inertial fuze;

direct-impact firing means including an axially-movable firing member in said ogive and a second detonator adjacent to the front side of said fuze loop and aligned with said firing member; and at least one explosive charge in said base adjacent to said rear side of said fuze loop;

whereby said explosive charge can be independently initiated, through said fuze loop, by either said inertial fuze or said direct-impact firing means.

6. A fuze structure as in claim 5, wherein said inertial fuze further includes:

a firing pin adapted to explode said first detonator, means for locking said firing pin in safe position spaced from said first detonator prior to impact, and inertia-operated means responsive to transverse graze impact for releasing said firing pin locking means.

7. A fuze as in claim 5, wherein said direct impact firing means comprises spring means biasing said firing member forwardly away from said second detonator, prior to impact with a target.

8. A fuze as in claim 5, wherein said direct impact firing means comprises a super-quick detonator and a delay detonator, both coupled to said fuse loop, and said firing member includes selective means for firing either detonator when actuated by impact with a target.

9. A fuze as in claim 8, wherein:

said firing member is a cylindrical member slidably and rotatably mounted in an axial cylindrical bore in said ogive member, and comprises an eccentric firing pin facing said detonators; and said detonators are eccentrically mounted so that either of said detonators may be fired by said firing pin by rotating said firing member to either of two predetermined angular positions.

10. A fuze as in claim 9, comprising means, including a plurality of spring-biased detent balls in said ogive member and longitudinal grooves in said firing member, for holding said firing member in a selected angular position after impact.

11. A fuze as in claim 9, wherein said direct impact firing means comprises means, including a spring-biased, spin releasable detent ball in said ogive member and a circumferential groove in said firing member, for holding said firing member in a safe position prior to spin-up during launch.

* * * * *